US009065191B2

(12) United States Patent
Martin et al.

(10) Patent No.: US 9,065,191 B2
(45) Date of Patent: Jun. 23, 2015

(54) SINGLE FASTENER ELECTRICAL CONNECTOR

(71) Applicant: Hubbell Incorporated, Shelton, CT (US)

(72) Inventors: Evan Martin, Derry, NH (US); Mike Rzasa, Nashua, NH (US)

(73) Assignee: Hubbell Incorporated, Shelton, CT (US)

( * ) Notice: Subject to any disclaimer, the term of this patent is extended or adjusted under 35 U.S.C. 154(b) by 33 days.

(21) Appl. No.: 13/775,419

(22) Filed: Feb. 25, 2013

(65) Prior Publication Data

US 2014/0242853 A1 Aug. 28, 2014

(51) Int. Cl.
*H01R 4/42* (2006.01)

(52) U.S. Cl.
CPC ..... *H01R 4/42* (2013.01)

(58) Field of Classification Search
USPC ..... 439/781, 99, 92, 97, 871, 434, 479; 174/84 C
See application file for complete search history.

(56) References Cited

U.S. PATENT DOCUMENTS

| | | | |
|---|---|---|---|
| 325,235 | A | 9/1885 | Bulmer et al. |
| 329,615 | A | 11/1885 | Andrews |
| 878,476 | A | 2/1908 | Barker |
| 1,183,174 | A | 5/1916 | Dice |
| 1,724,595 | A | 8/1929 | Hyle |
| 1,878,199 | A | 9/1932 | Stenger |
| 1,916,526 | A | 7/1933 | Olson |
| 2,034,258 | A | 3/1936 | Hausser |
| 2,034,494 | A | 3/1936 | Stoll |
| 2,069,402 | A | 2/1937 | Cowlin |
| 2,149,359 | A | 3/1939 | Olson |
| 2,179,575 | A | 11/1939 | Hosking |
| 2,250,280 | A | 7/1941 | Starbird |

(Continued)

FOREIGN PATENT DOCUMENTS

| | | |
|---|---|---|
| FR | 769005 | 8/1934 |
| FR | 49768 | 7/1939 |
| JP | 06309640 | 11/1994 |

OTHER PUBLICATIONS

International Search Report and Written Opinion; International Searching Authority of the World Intellectual Property Organization; International Application No. PCT/US14/18321; mail date: Jun. 2, 2014; search date: May 13, 2014; Alexandria, Virginia.

(Continued)

*Primary Examiner* — Alexander Gilman
(74) *Attorney, Agent, or Firm* — Roylance, Abrams, Berdo & Goodman, L.L.P.

(57) ABSTRACT

A one-piece metallic connector is configured to receive a fastener and has features that grip and electrically bond two conductors as they are clamped together when the fastener is tightened. The connector's generally U-shaped body has first and second legs, a bight portion joining the legs and an opening in each leg through which a single mounting fastener can extend. When installed with the outside of one leg abutting one conductor, another conductor is clamped between the legs. At least one outer projection (tooth) on the outer face of one leg engages the conductor to which the connector is mounted. At least one inner projection (tooth) on the same leg engages the conductor clamped between the legs. A recess on the inner face of the distal portion of the other leg is configured to cradle the clamped conductor.

15 Claims, 5 Drawing Sheets

(56) References Cited

U.S. PATENT DOCUMENTS

| | | | | | |
|---|---|---|---|---|---|
| 2,271,732 | A | | 2/1942 | Chappuis | |
| 2,561,679 | A | | 7/1951 | Waller | |
| 2,651,766 | A | * | 9/1953 | Runde | 439/781 |
| 2,796,457 | A | | 6/1957 | Stinger | |
| 2,934,684 | A | | 4/1960 | Fegan | |
| 2,934,737 | A | | 4/1960 | Gibson | |
| 3,138,658 | A | | 6/1964 | Weimer | |
| 3,175,462 | A | | 3/1965 | Disley | |
| 3,247,316 | A | | 4/1966 | Weimer, Jr. | |
| 3,253,247 | A | | 5/1966 | Vos | |
| 3,285,313 | A | | 11/1966 | Blakesley | |
| 3,340,494 | A | * | 9/1967 | Gutshall | 439/434 |
| 3,481,381 | A | | 12/1969 | Black | |
| 3,504,101 | A | | 3/1970 | Muto | |
| 3,541,226 | A | * | 11/1970 | Cea et al. | 174/84 C |
| 3,541,227 | A | | 11/1970 | Bendrick | |
| 3,626,357 | A | * | 12/1971 | Kindell et al. | 439/433 |
| 3,643,006 | A | * | 2/1972 | Ance | 399/144 |
| 3,715,705 | A | | 2/1973 | Kuo | |
| 3,719,919 | A | | 3/1973 | Tibolla | |
| 3,761,867 | A | | 9/1973 | Churla | |
| 3,810,069 | A | | 5/1974 | Jaconette, Jr. | |
| 4,022,262 | A | | 5/1977 | Gunn | |
| 4,023,882 | A | | 5/1977 | Pettersson | |
| 4,256,359 | A | | 3/1981 | Storck | |
| 4,263,474 | A | | 4/1981 | Tennant | |
| 4,353,612 | A | * | 10/1982 | Meyers | 439/99 |
| 4,406,505 | A | | 9/1983 | Avramovich | |
| 4,473,714 | A | | 9/1984 | Brownell et al. | |
| 4,498,715 | A | | 2/1985 | Peppler | |
| 4,560,224 | A | | 12/1985 | Weisenburger | |
| 4,571,013 | A | * | 2/1986 | Suffi et al. | 439/99 |
| 4,659,870 | A | | 4/1987 | Jones | |
| 4,704,058 | A | | 11/1987 | Grunwell | |
| 4,875,876 | A | | 10/1989 | O'Loughlin | |
| 4,900,209 | A | | 2/1990 | Reynolds | |
| 4,961,712 | A | | 10/1990 | Schwenk et al. | |
| 5,078,613 | A | | 1/1992 | Salmon | |
| 5,100,506 | A | | 3/1992 | Sturtevant et al. | |
| 5,207,588 | A | | 5/1993 | Ladouceur et al. | |
| 5,236,272 | A | | 8/1993 | Hibbard | |
| 5,361,657 | A | | 11/1994 | Terry | |
| 5,399,096 | A | | 3/1995 | Quillet et al. | |
| 5,435,746 | A | | 7/1995 | Leeb | |
| 5,441,417 | A | | 8/1995 | Ladouceur et al. | |
| 5,453,027 | A | | 9/1995 | Buell et al. | |
| 5,501,008 | A | | 3/1996 | Leeb | |
| 5,620,290 | A | | 4/1997 | Homfeldt et al. | |
| 5,644,830 | A | | 7/1997 | Ladouceur et al. | |
| 5,828,008 | A | | 10/1998 | Lockwood et al. | |
| 6,297,447 | B1 | | 10/2001 | Burnett et al. | |
| 6,322,378 | B1 | * | 11/2001 | Auclair | 439/99 |
| 6,343,904 | B1 | | 2/2002 | Wang | |
| 6,347,915 | B1 | | 2/2002 | Balzano | |
| 6,368,038 | B1 | | 4/2002 | Uno | |
| 6,702,596 | B2 | * | 3/2004 | Auclair | 439/99 |
| 6,939,097 | B2 | | 9/2005 | Carr et al. | |
| 6,976,816 | B2 | | 12/2005 | Slesinski et al. | |
| 6,987,660 | B2 | | 1/2006 | Stevenson et al. | |
| 7,666,024 | B2 | * | 2/2010 | De France | 439/479 |
| 7,686,625 | B1 | | 3/2010 | Dyer et al. | |
| 8,092,129 | B2 | | 1/2012 | Wiley et al. | |
| 2003/0031526 | A1 | | 2/2003 | Grant | |
| 2008/0053517 | A1 | | 3/2008 | Plaisted et al. | |
| 2010/0095492 | A1 | | 4/2010 | Boone | |

OTHER PUBLICATIONS

Wiley Index of WEEB Datasheets, Wiley Electronics LLC 2011.
Wiley WEEB Lug Datasheet, Burndy LLC 2012.
Wiley WEEB DP&W Solar Power FAB CRS Installation Instructions, Wiley Electronics LLC 2006-2010.
Wiley WEEB Solar Liberty Smart Raxx Installation Instructions, Wiley Electronics LLC 2006-2009.

* cited by examiner

SINGLE FASTENER ELECTRICAL CONNECTOR

FIELD OF THE INVENTION

The invention relates to connectors for creating an electrical bond between metallic conductors that are to be mechanically fastened together, such as for grounding a metallic structure through a grounding conductor.

BACKGROUND OF THE INVENTION

Safety dictates electrical grounding of exposed metallic parts of equipment housings or frames if there is a possibility that such parts could carry a current. For example, photovoltaic arrays need to be grounded because they produce electricity and are installed outdoors, exposed to the elements. Such arrays typically comprise a number of photovoltaic modules that are assembled onto a larger mounting structure and must be bonded to each other as well as to the grounded mounting structure. Bonded is used here in the technical sense to mean permanently joined to form an electrically conductive path that ensures electrical continuity and has the capacity to safely conduct any current likely to be imposed. The frames of the individual modules and the structural members on which the modules are mounted usually are made of aluminum. The aluminum is anodized to resist corrosion but the anodic coating insulates these pieces so that simple piece-to-piece contact does not electrically bond them together.

A common practice is to install a separate metallic grounding lug on each anodized piece. The grounding lug is mounted to the metal frame of a module by a thread-forming stainless steel screw with a star washer sandwiched between them. The grounding lug accepts a copper wire, which is forced into contact with the grounding lug by a stainless steel set screw. Thus, aside from the mounting screw, there are three parts involved in making such a bonded connection: a lug, a star washer and a set screw. U.S. Pat. No. 8,092,129 to Wiley, et al., which is incorporated by reference herein in its entirety, discloses various types of "bonding washers" that are positioned between the metallic pieces of photovoltaic modules and module supporting structures and pierce the anodic coating to create an electrical bond when the pieces are clamped together. FIGS. 33 and 34 show a grounding lug assembly for use when only one of the metallic pieces has an anodic coating, such as for bonding a ground wire to that piece. That assembly, too, has at least three parts besides the mounting screw.

SUMMARY OF THE INVENTION

The invention is directed to a metallic, one-piece electrical connector configured to receive a fastener and having features that grip and electrically bond two conductors as they are clamped together when the fastener is tightened. For example, the fastener may be threaded, one of the conductors may be a solar panel rack member and the other conductor may be a ground wire.

An electrical connector according to the invention comprises a one-piece, generally U-shaped metal body having a first leg, a second leg and a bight portion joining the legs. Each leg has an inner face, an outer face and a distal portion remote from the bight portion. The inner faces oppose one another and the distal portions are spaced to receive a first conductor between them. A first opening in the first leg and a second opening in the second leg are aligned to permit a fastener to extend through both openings. At least one outer projection is formed on the second leg and extends outward from the second leg's outer face for engaging a second conductor. A recess on the inner face of the distal portion of the first leg cradles the first conductor. At least one inner projection is formed on the distal portion of the second leg and extends inward from its inner face for engaging the first conductor. Thus, when a fastener is placed through the openings and is tightened with the second conductor abutting the outer face of the second leg and the first conductor in the recess, the outer projection(s) on the second leg is/are forcibly pressed against the second conductor and the first conductor is clamped between the legs to forcibly press the inner projection(s) against the first conductor.

The inner and outer projections preferably comprise a plurality of teeth adapted to embed themselves in the respective conductors when the fastener is tightened. The distal edges of the teeth preferably are substantially circular. The distal portion of the first leg preferably is outwardly convex, and the recess comprises the concave inside of the distal portion.

In one exemplary embodiment, the recess, the inner teeth and at least one of the outer teeth are substantially coplanar, and at least one of the outer teeth is formed on a (preferably outwardly) folded terminal portion of the second leg disposed substantially parallel to the distal portion of the second leg. Preferably, the inner teeth are respectively aligned with the outer teeth to form sets of oppositely directed teeth.

In another exemplary embodiment, the outer teeth are offset from the plane containing the recess and the inner teeth, preferably lying in a plane substantially normal to the plane containing the recess and the inner teeth.

BRIEF DESCRIPTION OF THE DRAWING

Preferred embodiments of the disclosed invention are described in detail below purely as examples, with reference to the accompanying drawing, in which.

DETAILED DESCRIPTION OF THE INVENTION

Figure 1:
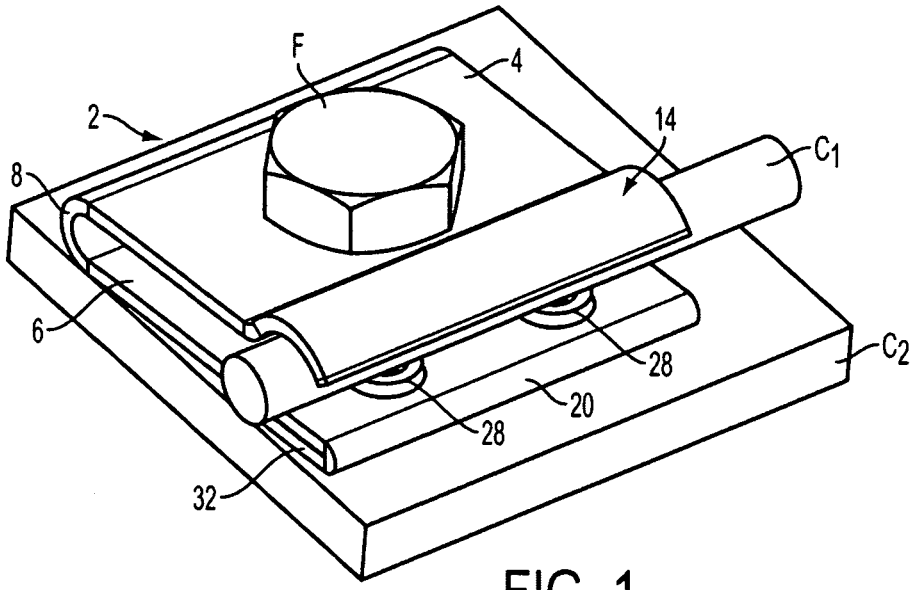
FIG. 1 is a perspective view of a first embodiment of the electrical connector of the invention shown assembled on a portion of a flat conductor and almost fully clamping a round conductor to the flat conductor.

Referring to FIGS. 1-4, a first embodiment of the electrical connector of the invention comprises a one-piece, generally U-shaped body 2 preferably made of stainless steel. Body 2 has a first leg 4, a second leg 6 and a bight portion 8 joining the legs. First leg 4 has an inner face 10, an outer face 12 and a distal portion 14 remote from bight portion 8. Second leg 6 has an inner face 16, an outer face 18 and a distal portion 20 remote from bight portion 8. Inner faces 10, 16 oppose one another and distal portions 14, 20 are spaced or can be urged apart to receive a first conductor $C_1$ between them. Legs 4, 6 have respective holes 22, 24 that are aligned to accommodate a fastener F, such as a threaded bolt, for securing the body to a second conductor $C_2$ with conductor $C_1$ clamped between the legs.

Figure 9:
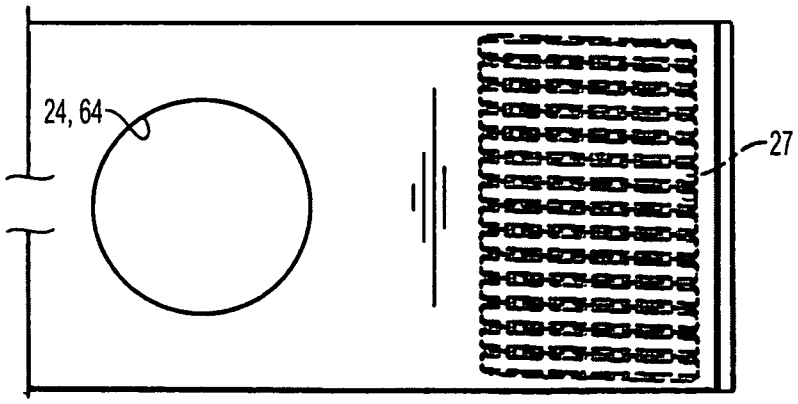
FIG. 9 is a detail plan view of an optional knurled clamping surface suitable for inclusion in any embodiment of the invention.

The distal portion 14 of first leg 4 preferably is curved outward as shown to provide an arcuate recess 26 on its inner face that cradles round conductor $C_1$. Distal portion 14 may be configured to provide a cradling recess of a different shape, for example, a V-shaped recess (not shown). Knurls 27 (see FIG. 9) optionally may be formed on the inner surface of recess 26 to enhance the grip on and bond with conductor $C_1$. Bonding with conductor $C_1$ primarily occurs at the distal portion 20 of second leg 6 by means of two inner teeth 28 that project from the leg's inner face 16. One tooth would suffice if it makes a good electrical bond; however, at least two teeth are preferred and all teeth directly oppose the longitudinal center of recess 26, i.e., the centers of teeth 28 and the center of recess 26 lie in a common plane $P_1$ (see FIGS. 2-4).

Bonding with conductor $C_2$ occurs at the distal portion 20 of second leg 6 by means of two outer teeth 30 that project from the leg's outer face 18. Teeth 30 are formed on a terminal portion 32 of leg 6 that is folded outward 180° substantially flat against the remainder of distal portion 20. Here, too, one tooth 30 would suffice if it makes a good electrical bond; however, at least two teeth 30 are preferred, the number being equal to the number of inner teeth 28. Each outer tooth 30 preferably is aligned with a respective inner tooth 28 so as to form sets of aligned, oppositely directed teeth, all of which lie in common plane $P_1$. Thus, when fastener F is installed and tightened, the clamping force exerted by the connector on conductors $C_1$ and $C_2$ acts directly along common plane $P_1$, maximizing the penetrating effect of the teeth on their respective conductors.

Figure 2:
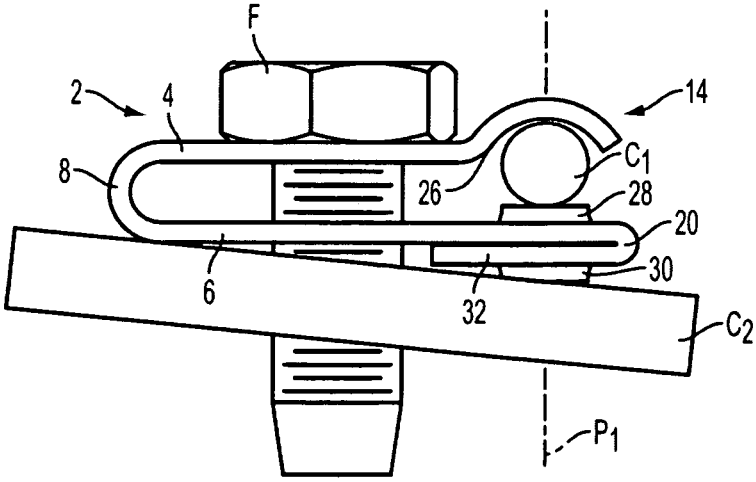
FIG. 2 is a side elevational view of the assembly of FIG. 1.
Figure 3:
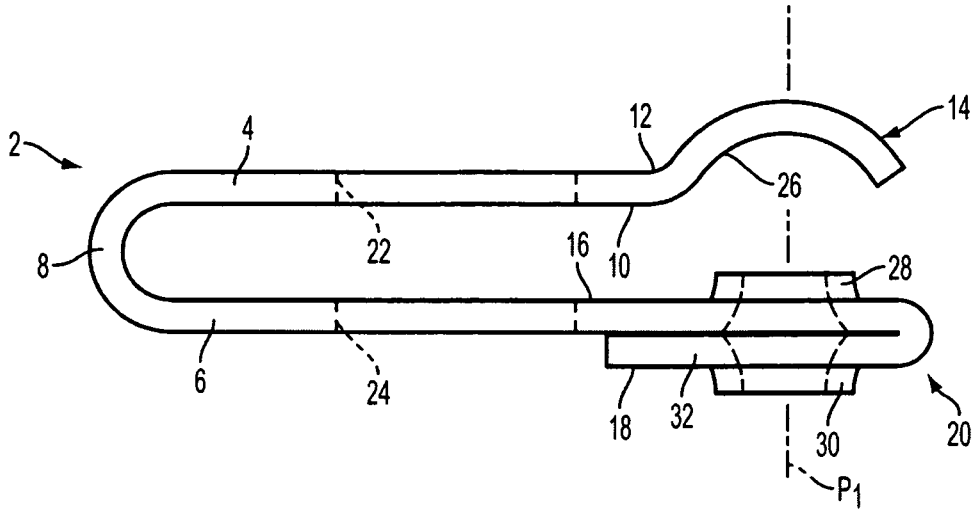
FIG. 3 is a side elevational view of the first embodiment of FIG. 1 per se.
Figure 4:
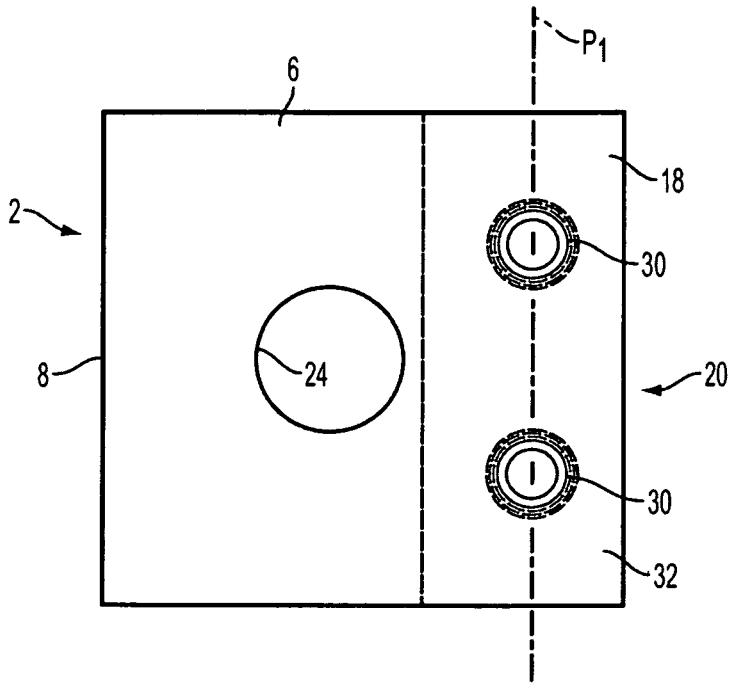
FIG. 4 is bottom plan view of the first embodiment of FIG. 3.
Figure 5:
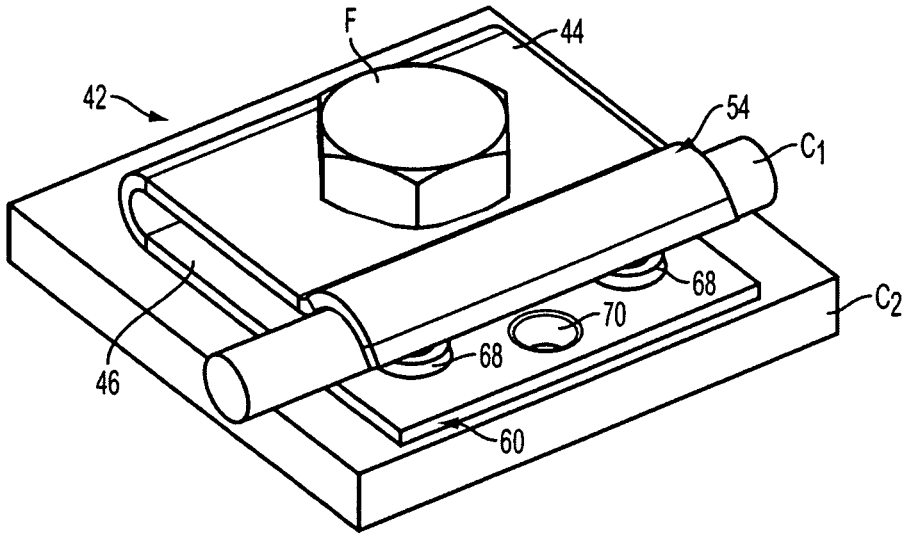
FIG. 5 is a perspective view of a second embodiment of the electrical connector of the invention shown assembled on a portion of a flat conductor and almost fully clamping a round conductor to the flat conductor.
Figure 6:
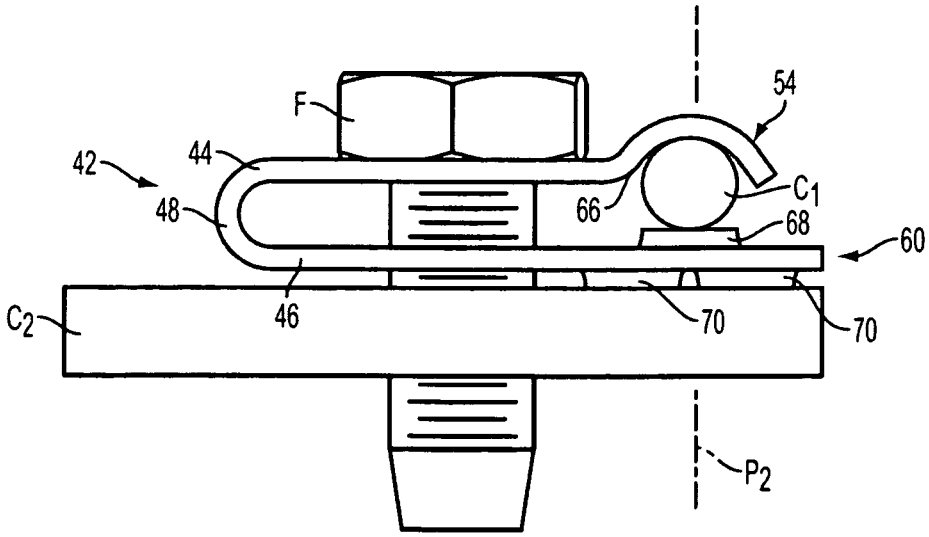
FIG. 6 is a side elevational view of the assembly of FIG. 5.
Figure 7:
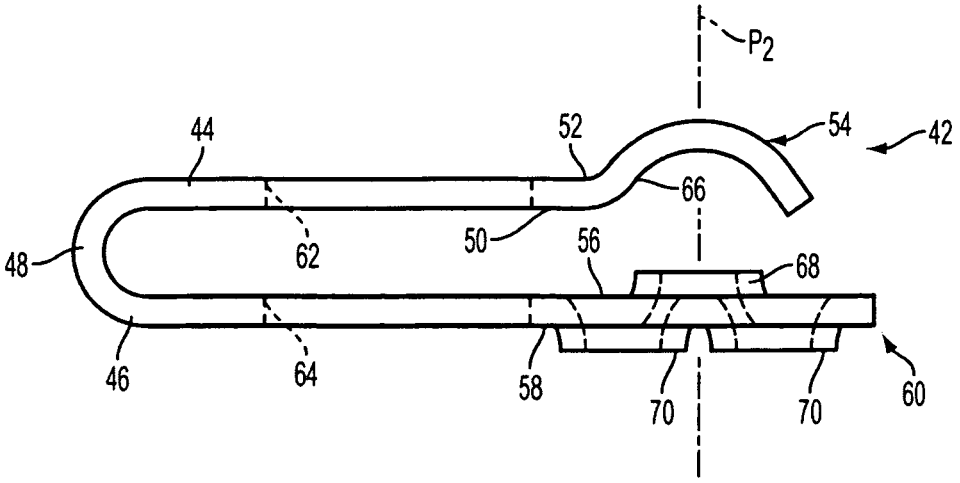
FIG. 7 is a side elevational view of the second embodiment of FIG. 4 per se.
Figure 8:
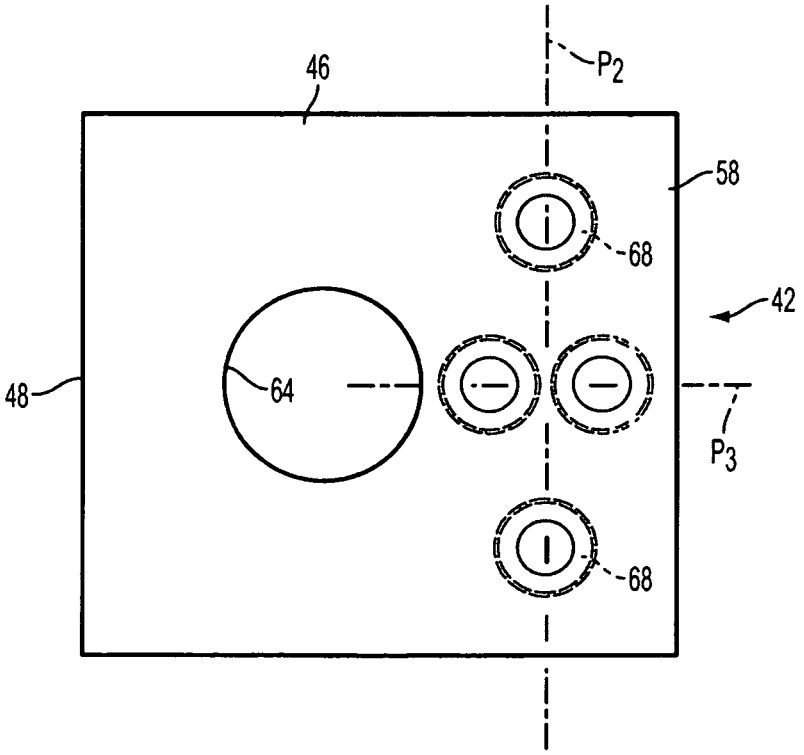
FIG. 8 is a bottom plan view of the second embodiment of FIG. 7.

Referring to FIG. 2, the outwardly folded terminal portion 32 of second leg 6 results in a thicker distal portion 20 and thus causes second leg 6 to be slightly inclined relative to conductor $C_2$. As shown, this geometry initially focuses the clamping force of teeth 30 through a smaller area, resulting in an enhanced ability to break anodic coatings. When the fastener is tightened further for full clamping effect (not shown) the sharp distal edge of terminal portion 32 may also penetrate the coating. The clamping force is optimized by keeping the distance from common plane $P_1$ to bight portion 8 as short as practicable and locating holes 22, 24 (and hence fastener F) fairly close to common plane $P_1$, preferably not more than about half the distance from common plane $P_1$ to bight portion 8.

Teeth 28 and 30 may be any of the types of teeth disclosed in the aforesaid U.S. Pat. No. 8,092,129 to Wiley, et al., such as those shown in FIGS. 3-8 and described at col. 7, lines 14-31 thereof. The preferred tooth form is circular and the connector may have a thin coating of a material such as chromium or titanium nitride in order to achieve the desired tooth hardness so that the teeth can penetrate anodic coatings and become embedded in the underlying metal.

Referring to FIGS. 5-8, a second embodiment of the electrical connector of the invention similarly comprises a one-piece, generally U-shaped body 42, preferably made of stainless steel, having a first leg 44, a second leg 46 and a bight portion 48 joining the legs. First leg 44 has an inner face 50, an outer face 52 and a distal portion 54 remote from bight portion 48. Second leg 46 has an inner face 56, an outer face 58 and a distal portion 60 remote from bight portion 48. Inner faces 50, 56 oppose one another and distal portions 54, 60 are spaced or can be urged apart to receive a first conductor $C_1$ between them. Legs 44, 46 have respective holes 62, 64 that are aligned and located to accommodate a fastener F as described above in connection with the first embodiment. The distal portion 54 of first leg 44 similarly is preferably curved outward as shown to provide an arcuate recess 66 on its inner face that cradles round conductor $C_1$. Knurls 27 (see FIG. 9) and other recess shapes may be used as described above.

Bonding with conductor $C_1$ in this embodiment is similarly accomplished by means of two inner teeth 68 at the distal portion 60 of second leg 46 that project from the leg's inner face 56. Here, too, one tooth would suffice if it makes a good electrical bond; however, at least two teeth 68 are preferred and all teeth directly oppose the longitudinal center of recess 66, i.e., the centers of teeth 68 and the center of recess 66 lie in a common plane $P_2$ (see FIGS. 6-8). Bonding with conductor $C_2$ also occurs at the distal portion 60 of second leg 46 by means of two outer teeth 70 that project from the leg's outer face 58. In contrast to the first embodiment, however, the distal portion of second leg 46 is not folded; and outer teeth 70 are offset from plane $P_2$ and are centered along a plane $P_3$ that is perpendicular to plane $P_2$ (see FIG. 6). Tooth design options are preferably the same as those described in connection with the first embodiment.

The one-piece construction and configuration of the above embodiments make installation of these electrical connectors fast and easy: (1) a bolt is placed through the holes in the legs, (2) the legs are spread slightly to embrace conductor $C_1$, and (3) the bolt is inserted in a predrilled hole in conductor $C_2$ and driven home to clamp the parts together. Some installers may find it more convenient to reverse steps 1 and 2. Either way, the result is a quick and effective electrical bond.

While preferred embodiments have been chosen to illustrate the electrical connector of the invention, it will be understood by those skilled in the art that various changes and modifications may be made without departing from the scope of the invention as defined by the appended claims.

What is claimed is:

1. An electrical connector for connecting a first conductor to a second conductor when secured by a fastener, comprising:

a one-piece, generally U-shaped metal body having a first leg, a second leg and a bight portion joining said legs, each of said legs having an inner face, an outer face and a distal portion remote from said bight portion, said inner faces opposing one another and said distal portions spaced to receive the first conductor therebetween;

a first opening in said first leg;

a second opening in said second leg, said first and second openings being substantially aligned to permit a fastener to extend therethrough;

at least one outer projection formed on said second leg extending outward from the outer face thereof for engaging the second conductor;

a recess on the inner face of the distal portion of said first leg configured to cradle the first conductor; and at least one internal projection formed on the distal portion of said second leg and extending inward from the inner face thereof for engaging the first conductor, whereby, when a fastener extending through said openings is tightened with the second conductor abutting the outer face of said second leg and the first conductor in said recess, said at least one outer projection is forcibly pressed against the second conductor and the first conductor is clamped by said legs to forcibly press said at least one internal projection against the first conductor, wherein the distal portion of said first leg is outwardly convex, and said recess comprises the concave inside of said outwardly convex distal portion, wherein said recess comprises a knurled surface, wherein said at least one internal projection and said recess are substantially opposed, and wherein said at least one outer projection comprises a plurality of outer teeth, said at least one internal projection comprises a plurality of internal teeth, and each of said teeth has a distal edge adapted to embed itself in a respective conductor when the fastener is tightened.

2. The electrical connector of claim 1, wherein the distal edge of each of said teeth is substantially circular.

3. The electrical connector of claim 1, wherein said recess and said internal teeth are substantially coplanar.

4. The electrical connector of claim 3, wherein said first and second openings are located substantially midway between said bight portion and the plane containing said recess and said internal teeth.

5. The electrical connector of claim 3, wherein said recess, said internal teeth and at least one of said outer teeth are substantially coplanar.

6. The electrical connector of claim 5, wherein said first and second openings are located substantially midway between said bight portion and the plane containing said recess and said internal teeth.

7. The electrical connector of claim 5, wherein at least one of said outer teeth is formed on a folded terminal portion of said second leg disposed substantially parallel to the distal portion of said second leg.

8. The electrical connector of claim 7, wherein said terminal portion is folded outwardly.

9. The electrical connector of claim 8, comprising two internal teeth, and two outer teeth formed on said terminal portion.

10. The electrical connector of claim 9, wherein said two internal teeth are respectively aligned with said two outer teeth so as to form two sets of oppositely directed teeth.

11. The electrical connector of claim 10, wherein the distal portion of said first leg is outwardly convex, and said recess comprises the concave inside of said outwardly convex distal portion.

12. The electrical connector of claim 3, wherein said outer teeth are offset from the plane containing said recess and said internal teeth.

13. The electrical connector of claim 12, wherein said first and second openings are located substantially midway between said bight portion and the plane containing said recess and said internal teeth.

14. The electrical connector of claim 12, wherein said outer teeth lie in a plane that is substantially normal to the plane containing said recess and said internal teeth.

15. The electrical connector of claim 13, wherein the distal portion of said first leg is outwardly convex, and said recess comprises the concave inside of said outwardly convex distal portion.

* * * * *